US010994566B1

(12) United States Patent
Chang

(10) Patent No.: US 10,994,566 B1
(45) Date of Patent: May 4, 2021

(54) PAPER PROCESSING DEVICE

(71) Applicant: PRIMAX ELECTRONICS LTD., Taipei (TW)

(72) Inventor: Yu-Lun Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 30 days.

(21) Appl. No.: 16/721,976

(22) Filed: Dec. 20, 2019

(30) Foreign Application Priority Data

Oct. 25, 2019 (TW) ..... 108138668

(51) Int. Cl.

| | |
|---|---|
| ***B65H 31/26*** | (2006.01) |
| ***B42C 1/12*** | (2006.01) |
| ***B65H 29/12*** | (2006.01) |
| ***B65H 43/08*** | (2006.01) |
| ***B65H 37/04*** | (2006.01) |

(52) U.S. Cl.
CPC ..... *B42C 1/12* (2013.01); *B65H 29/12* (2013.01); *B65H 31/26* (2013.01); *B65H 37/04* (2013.01); *B65H 43/08* (2013.01); *B65H 2301/4223* (2013.01)

(58) Field of Classification Search
CPC ..... B42C 1/12; B65H 31/26; B65H 37/04; B65H 2301/4223
See application file for complete search history.

(56) References Cited

U.S. PATENT DOCUMENTS

| | | | | |
|---|---|---|---|---|
| 7,922,164 | B2 * | 4/2011 | Nakayama | B65H 31/26 270/58.12 |
| 7,922,435 | B2 * | 4/2011 | Sanmiya | B65H 31/26 412/9 |
| 8,123,209 | B2 * | 2/2012 | Kubota | B65H 37/04 270/58.07 |
| 8,286,964 | B2 * | 10/2012 | Jung | B65H 31/10 271/220 |
| 9,272,872 | B2 * | 3/2016 | Sugiyama | B65H 31/36 |
| 10,414,616 | B2 * | 9/2019 | Shin | B65H 31/10 |

* cited by examiner

*Primary Examiner* — Leslie A Nicholson, III
(74) *Attorney, Agent, or Firm* — WPAT, PC

(57) ABSTRACT

A paper processing device includes a casing, a transfer roller assembly and a paper pressing mechanism. The casing includes a paper placement platform. The plural papers from a printing device are transferred to the paper placement platform by the transfer roller assembly. The paper pressing mechanism is located under the casing. The paper pressing mechanism includes a support frame, a pressing bar, a driving mechanism and a linking mechanism. The pressing bar includes a protrusion block. The protrusion block is penetrated through an opening of the casing. The protrusion block and the paper placement platform face each other. The linking mechanism is connected between the driving mechanism and the pressing bar. While the linking mechanism is driven by the driving mechanism, the pressing bar is moved linearly relative to the support frame, and the protrusion block is moved from an initial position to a target position.

10 Claims, 5 Drawing Sheets

PAPER PROCESSING DEVICE

FIELD OF THE INVENTION

The present invention relates to a paper processing device, and more particularly to a paper processing device with a paper pressing mechanism.

BACKGROUND OF THE INVENTION

Printing devices are essential information apparatuses in modern offices. For example, the printing devices include copiers, printers, scanners and office machines. Among these printing devices, printers are the most popular. Generally, when a printer is connected with a computer, the electronic file in the computer may be printed on a blank paper. In a case that the electronic file contains numerous data, the electronic file needs to be printed on at least two blank papers. For facilitating managing and filing the printed papers, the stack of printed papers are removed from the paper outlet tray of the printing device, and then aligned and stapled. Due to the stapling operation, these papers are combined together without being disorderly spread everywhere.

For most users, the printing operation of the printer has to be finished before the stapling operation is manually done. Since different electronic files to be printed have different data amounts, the time periods of waiting for the implementation of the printing operation are usually different. Under this circumstance, the user usually fails to efficiently manage the printed papers. For solving this problem, a paper processing device with a stapling function has been disclosed.

Generally, the conventional processing device comprises a paper placement platform. The multi-page document outputted from the printer or the scanner can be placed on the paper placement platform.

After the multi-page document is placed on the paper placement platform, a paper-aligning action, a stapling action, a punching action or an associated action is performed to process the multi-page document. Then, the processed multi-page document is ejected out of the office machine. Consequently, the processed multi-page document can be taken by the user.

However, the conventional paper processing device still has some drawbacks. For example, while the multi-page document drops to the paper placement platform, the multi-page document is possibly uplifted or bent. While the plural pages of the multi-page document drop to the paper placement platform sequentially, the papers dropping to the paper placement platform at the later stage are influenced by the papers on the paper placement platform. Under this circumstance, the plural multi-page document cannot be well ordered. For solving this drawback, the paper processing device is equipped with a paper pressing mechanism. While the multi-page document drops to the paper placement platform, the multi-page document is flattened by the paper pressing mechanism. Consequently, the multi-page document on the paper placement platform can be stacked orderly.

The conventional paper processing device comprises a driving mechanism and a linking mechanism. The linking mechanism is connected with the driving mechanism. During the operation of the paper pressing mechanism, the linking mechanism is driven by the driving mechanism to rotate the paper pressing mechanism. Since the paper pressing mechanism is operated through rotation, a large layout space is required. Moreover, while the paper pressing mechanism is operated through rotation, the uplifted papers are readily kicked out by the paper pressing mechanism. Consequently, the purpose of flattening the papers cannot be achieved.

Therefore, there is a need of providing an improved paper processing device in order to overcome the above drawbacks.

SUMMARY OF THE INVENTION

An object of the present invention provides a paper processing device. By a driving mechanism and a linking mechanism, a pressing bar is moved in a linear direction. Consequently, the uplifted papers are not kicked out by the pressing bar during the linear movement. Due to the linear movement of the pressing bar, the occupied space of the pressing bar in the paper processing device is largely reduced.

The other objects and advantages of the present invention will be understood from the disclosed technical features.

In accordance with an aspect of the present invention, a paper processing device is provided for processing plural papers from a printing device. The paper processing device includes a casing, a transfer roller assembly and a paper pressing mechanism. The casing includes a paper placement platform. The paper placement platform is extended externally from the casing. The transfer roller assembly is installed on the casing. The plural papers from the printing device are transferred to the paper placement platform by the transfer roller assembly. The paper pressing mechanism is located under the casing. The paper pressing mechanism includes a support frame, a pressing bar, a driving mechanism and a linking mechanism. The pressing bar is installed on the support frame, and includes a protrusion block. The protrusion block is penetrated through an opening of the casing. The protrusion block and the paper placement platform face each other. The driving mechanism is installed on the support frame. The linking mechanism is installed on the support frame, and connected between the driving mechanism and the pressing bar. While the linking mechanism is driven by the driving mechanism, the pressing bar is moved with the linking mechanism and moved linearly relative to the support frame, and the protrusion block is moved from an initial position to a target position so as to be in contact with the plural papers.

In an embodiment, the pressing bar further includes a light-shielding structure, the paper pressing mechanism further includes a sensor, and the sensor is installed on the support frame and located beside the pressing bar. If a stack height of the plural papers is lower than a threshold height when the protrusion block is moved from the initial position to the target position and contacted with the plural papers, the light-shielding structure of the pressing bar is within a sensitive range of the sensor. If the stack height of the plural papers is higher than the threshold height when the protrusion block is moved from the initial position to the target position and contacted with the plural papers, the light-shielding structure of the pressing bar is not within the sensitive range of the sensor.

In an embodiment, the sensor is an infrared sensor, and the infrared sensor includes a signal emitter and a signal receiver. The signal emitter and the signal receiver are opposed to each other. The sensitive range of the sensor is defined by the signal emitter and the signal receiver collaboratively.

In an embodiment, the driving mechanism includes a solenoid valve body, an electromagnetic push rod and a spring. The electromagnetic push rod is installed in the solenoid valve body, and includes a connecting part and a contacting part. The connecting part and the contacting part are exposed outside the solenoid valve body. The contacting part is arranged between the connecting part and the solenoid valve body. The spring is sheathed around the electromagnetic push rod. Moreover, two ends of the spring are contacted with the solenoid valve body and the contacting part, respectively.

In an embodiment, the support frame includes a positioning shaft, the linking mechanism includes a linking structure and an elastic linkage, and the linking structure includes a first linking part, a second linking part and a pivotal hole. The first linking part is pivotally coupled to the connecting part of the electromagnetic push rod. The second linking part is connected with the elastic linkage. The pivotal hole is arranged between the first linking part and the second linking part. The positioning shaft of the support frame is pivotally coupled to the pivotal hole. The elastic linkage is connected between the pressing bar and the second linking part.

When the solenoid valve body is in an electrically-conducted state, the solenoid valve body drives a movement of the electromagnetic push rod in a first direction to compress the spring, and the movement of the electromagnetic push rod allows the linking structure to be swung relative to the positioning shaft, so that the first linking part is moved in the first direction and the second linking part is moved in a second direction opposite to the first direction. While the second linking part is moved in the second direction, the elastic linkage is stretched by the second linking part, so that the elastic linkage generates an elastic restoring force. In response to the elastic restoring force of the elastic linkage, the pressing bar is moved in the second direction, and the protrusion block is moved to the target position and contacted with the plural papers.

When the solenoid valve body is switched from the electrically-conducted state to a shut-off state, the compressed spring is released, wherein in response to an elastic restoring force of the spring, the electromagnetic push rod is moved in the second direction and the movement of the electromagnetic push rod allows the linking structure to be swung relative to the positioning shaft, so that the first linking part is moved in the second direction and the second linking part is moved in the first direction. While the second linking part is moved in the first direction, the elastic linkage is moved with the second linking part in the first direction, and the pressing bar is moved with the elastic linkage in the first direction, so that the protrusion block is returned from the target position to the initial position.

In an embodiment, the transfer roller assembly includes plural rollers, and the plural rollers are spaced apart. When the protrusion block of the pressing bar is in the initial position, the protrusion block is arranged between two adjacent rollers of the plural rollers.

In an embodiment, the paper pressing mechanism further includes a fastening element, and the pressing bar further includes a linear guiding slot. The fastening element is penetrated through the linear guiding slot and fixed on the support frame. The linear guiding slot includes a first stopping end and a second stopping end. The first stopping end and the second stopping end are opposed to each other. While the pressing bar is moved with the linking mechanism and moved linearly relative to the support frame and the protrusion block is moved to the target position, the first stopping end of the linear guiding slot is moved in a direction toward the fastening element. When the protrusion block of the pressing bar is in the initial position, the second stopping end of the linear guiding slot is contacted with the fastening element.

In an embodiment, the paper processing device further includes a stapling mechanism. The stapling mechanism is installed on the casing and located beside the paper placement platform. The plural papers on the paper placement platform are stapled by the stapling mechanism.

From the above descriptions, the present invention provides a paper processing device with a paper pressing mechanism. By the paper pressing mechanism, the papers on a paper placement platform is flattened and the stack height of the papers is sensed. The paper pressing mechanism comprises a pressing bar, a driving mechanism and a linking mechanism. By the driving mechanism and the linking mechanism, the pressing bar is moved upwardly or downwardly in the linear direction. Due to this design, the uplifted papers are not kicked out by the pressing bar during the linear movement. Consequently, the subsequent processes of flattening the papers and sensing the stack height of the papers can be performed more successfully. Moreover, the process of stacking the papers is not influenced by the linear movement of the pressing bar. Due to the linear movement of the pressing bar, the occupied space of the pressing bar in the paper processing device is largely reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
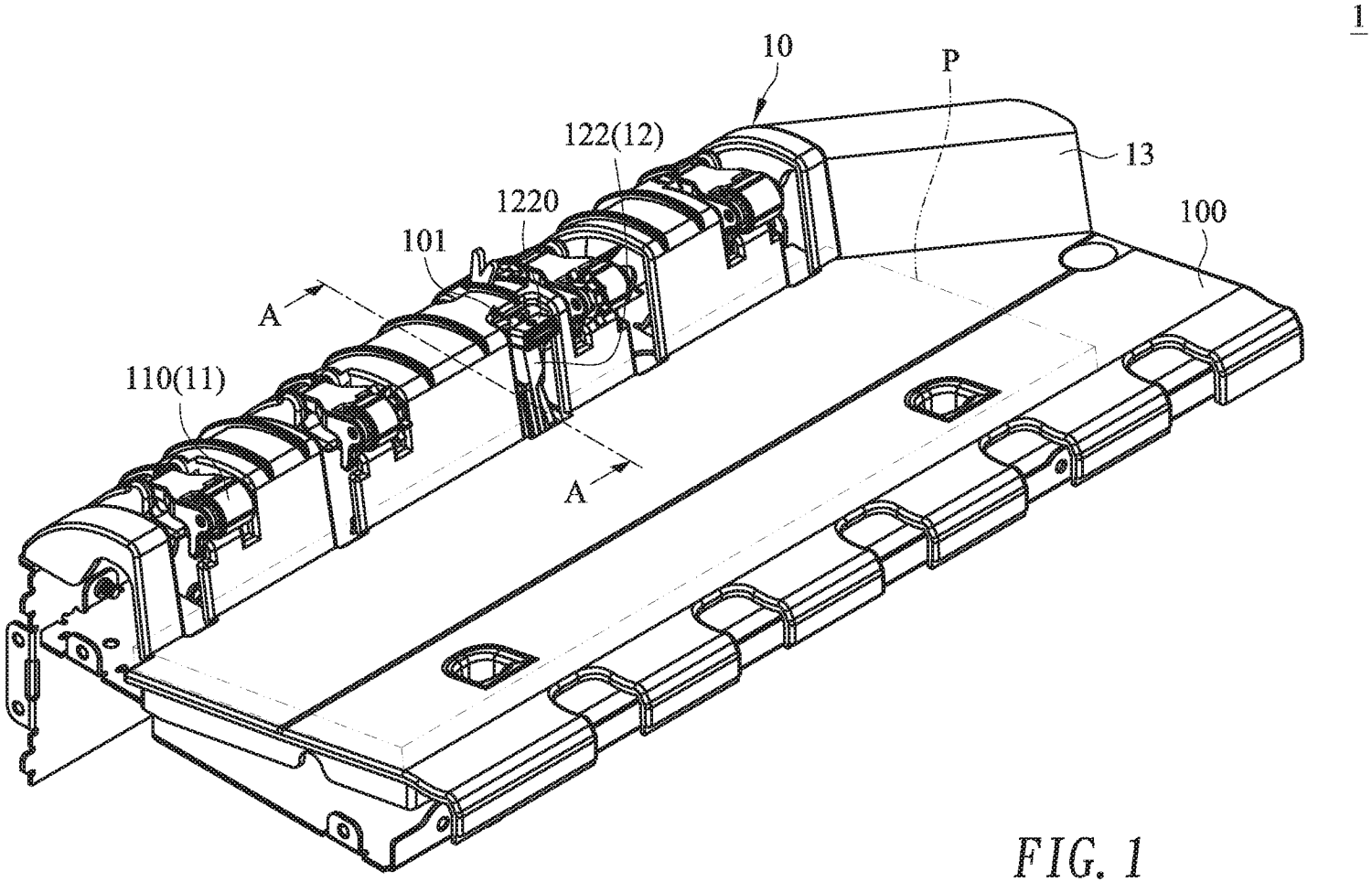
FIG. 1 is a schematic perspective view illustrating the appearance of a paper processing device according to an embodiment of the present invention.
Figure 2:
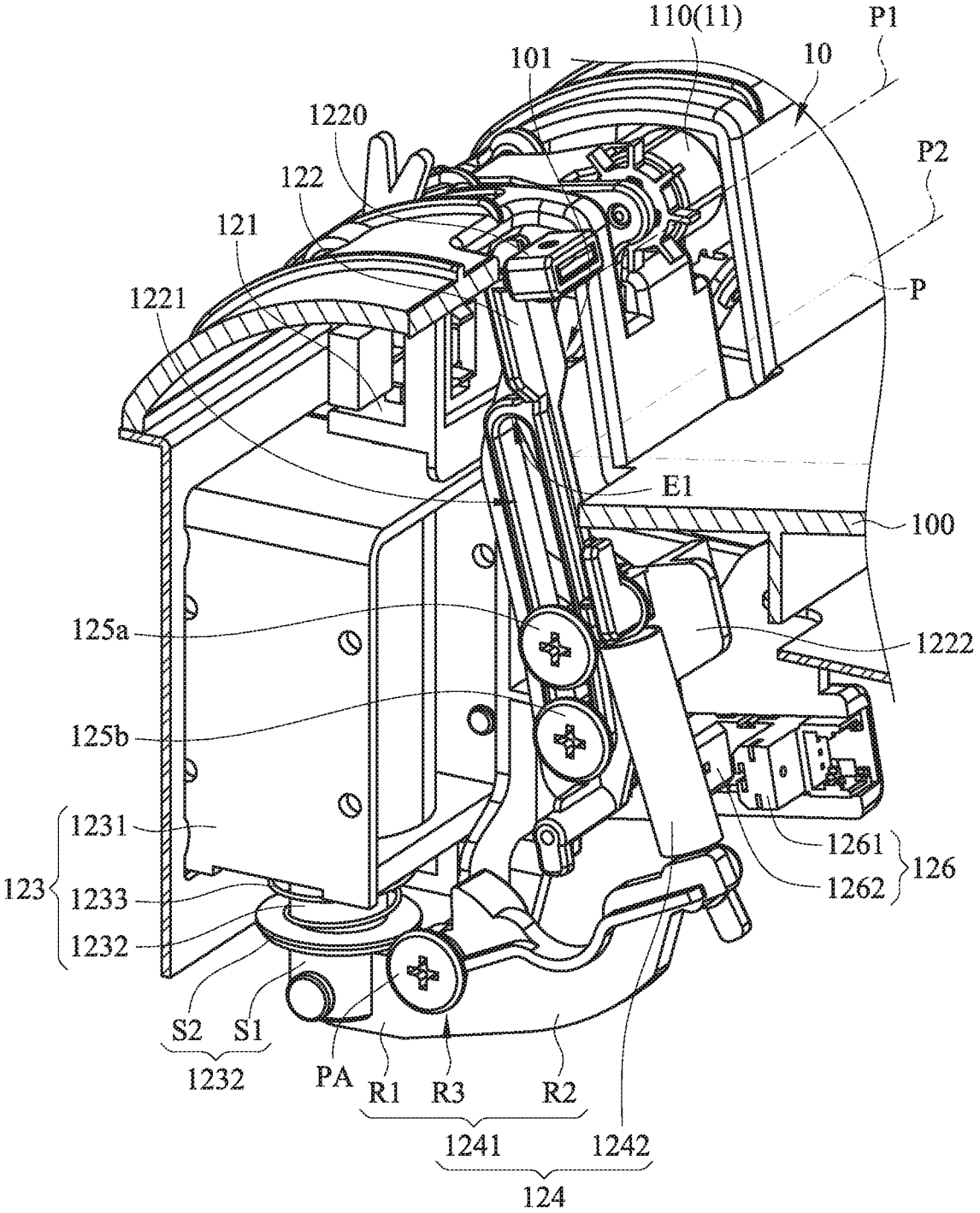
FIG. 2 is a schematic cutaway view illustrating a portion of the paper processing device as shown in FIG. 1 and taken along the line AA.

Please refer to FIGS. 1 and 2. FIG. 1 is a schematic perspective view illustrating the appearance of a paper processing device according to an embodiment of the present invention. FIG. 2 is a schematic cutaway view illustrating a portion of the paper processing device as shown in FIG. 1 and taken along the line AA. In an embodiment, the paper processing device 1 is installed over a printing device (not shown) or located at bilateral sides of the printing device. The paper processing device 1 used for processing plural papers P that are transported from the printing device. For example, the paper processing device 1 can perform a stapling action or a punching action on the papers P.

Please refer to FIGS. 1 and 2 again. In this embodiment, the paper processing device 1 comprises a casing 10, a transfer roller assembly 11 and a paper pressing mechanism 12. The casing 10 comprises a paper placement platform 100. The paper placement platform 100 is extended externally from the casing 10. The transfer roller assembly 11 is installed on the casing 10. By the transfer roller assembly 11, the papers P from the printing device can be transferred to the paper placement platform 100. The paper pressing mechanism 12 is located under the casing 10. The paper pressing mechanism 12 comprises a support frame 121, a pressing bar 122, a driving mechanism 123 and a linking mechanism 124. The pressing bar 122 is installed on the support frame 121. Moreover, the pressing bar 122 comprises a protrusion block 1220. The protrusion block 1220 is penetrated through an opening 101 of the casing 10. Consequently, the protrusion block 1220 and the paper placement platform 100 face each other. The driving mechanism 123 is installed on the support frame 121. In addition, the pressing bar 122 is arranged between the paper placement platform 100 and the driving mechanism 123. The linking mechanism 124 is installed on the support frame 121, and connected between the driving mechanism 123 and the pressing bar 122.

While the linking mechanism 124 is driven by the driving mechanism 123, the pressing bar 122 is moved with the linking mechanism 124. Consequently, the pressing bar 122 is moved linearly relative to the support frame 121. In such way, the protrusion block 1220 is moved from an initial position P1 to a target position P2. When the protrusion block 1220 is in the target position P2, the protrusion block 1220 is contacted with the papers P. The operations of the paper pressing mechanism 12 will be described in more details later.

The structure of the paper processing device 1 will be illustrated in more details as follows.

Please refer to FIG. 2 again. The driving mechanism 123 comprises a solenoid valve body 1231, an electromagnetic push rod 1232 and a spring 1233. The electromagnetic push rod 1232 is installed in the solenoid valve body 1231. The electromagnetic push rod 1232 comprises a connecting part S1 and a contacting part S2. The connecting part S1 and the contacting part S2 of the electromagnetic push rod 1232 are exposed outside the solenoid valve body 1231. The contacting part S2 is arranged between the connecting part S1 and the solenoid valve body 1231. The spring 1233 is sheathed around the electromagnetic push rod 1232. Moreover, the two ends of the spring 1233 are contacted with the solenoid valve body 1231 and the contacting part S2 of the electromagnetic push rod 1232, respectively.

Please refer to FIG. 2 again. The support frame 121 comprises a positioning shaft PA. The linking mechanism 124 comprises a linking structure 1241 and an elastic linkage 1242. The linking structure 1241 of the linking mechanism 124 comprises a first linking part R1, a second linking part R2 and a pivotal hole R3. The first linking part R1 of the linking structure 1241 is pivotally coupled to the connecting part S1 of the electromagnetic push rod 1232. The second linking part R2 of the linking structure 1241 is connected with the elastic linkage 1242. The pivotal hole R3 of the linking structure 1241 is arranged between the first linking part R1 and the second linking part R2. The positioning shaft PA of the support frame 121 is pivotally coupled to the pivotal hole R3 of the linking structure 1241. The elastic linkage 1242 is connected between the pressing bar 122 and the second linking part R2 of the linking structure 1241.

Please refer to FIG. 2 again. In this embodiment, the paper pressing mechanism 12 further comprises fastening elements 125*a* and 125*b*. Moreover, the pressing bar 122 further comprises a linear guiding slot 1221. In this embodiment, the number of the fastening elements is two. It is noted that the number of the fastening elements is not restricted. For example, in another embodiment, the paper pressing mechanism comprises one fastening element or more than two fastening elements. The fastening elements 125*a* and 125*b* are penetrated through the linear guiding slot 1221 of the pressing bar 122 and fixed on the support frame 121. Due to the cooperation between the fastening elements 125*a* and 125*b* and the linear guiding slot 1221, the pressing bar 122 is movably installed on the support frame 121. Moreover, while the pressing bar 122 is moved relative to the support frame 121, the cooperation between the fastening elements 125*a* and 125*b* and the linear guiding slot 1221 can prevent the detachment of the pressing bar 122 from the support frame 121. Consequently, the movable range of the pressing bar 122 along the linear direction is limited. Especially, the linear guiding slot 1221 of the pressing bar 122 comprises a first stopping end E1 and a second stopping end E2 (see FIG. 4). The first stopping end E1 and the second stopping end E2 are opposed to each other. While the pressing bar 122 is moved with the linking mechanism 124 and moved linearly relative to the support frame 121, the protrusion block 1220 is correspondingly moved. As the protrusion block 1220 is moved toward the target position P2, the first stopping end E1 of the linear guiding slot 1221 is moved in the direction toward the fastening element 125*a*. When the protrusion block 1220 of the pressing bar 122 is in the initial position P1, the second stopping end E2 of the linear guiding slot 1221 is contacted with the fastening element 125*b*.

As shown in FIG. 1, the paper processing device 1 further comprises a stapling mechanism 13. The stapling mechanism 13 is installed on the casing 10 and located beside the paper placement platform 100. The papers P on the paper placement platform 100 can be stapled by the stapling mechanism 13. It is noted that the example of installing the stapling mechanism 13 beside the paper placement platform 100 is not restricted. For example, in another embodiment, the paper processing device further comprises a punching mechanism beside the paper placement platform for performing a punching action. Alternatively, the paper processing device further comprises a mechanism with both of a stapling function and a punching function.

The operations of the paper processing device 1 will be illustrated in more details as follows.

Figure 3:
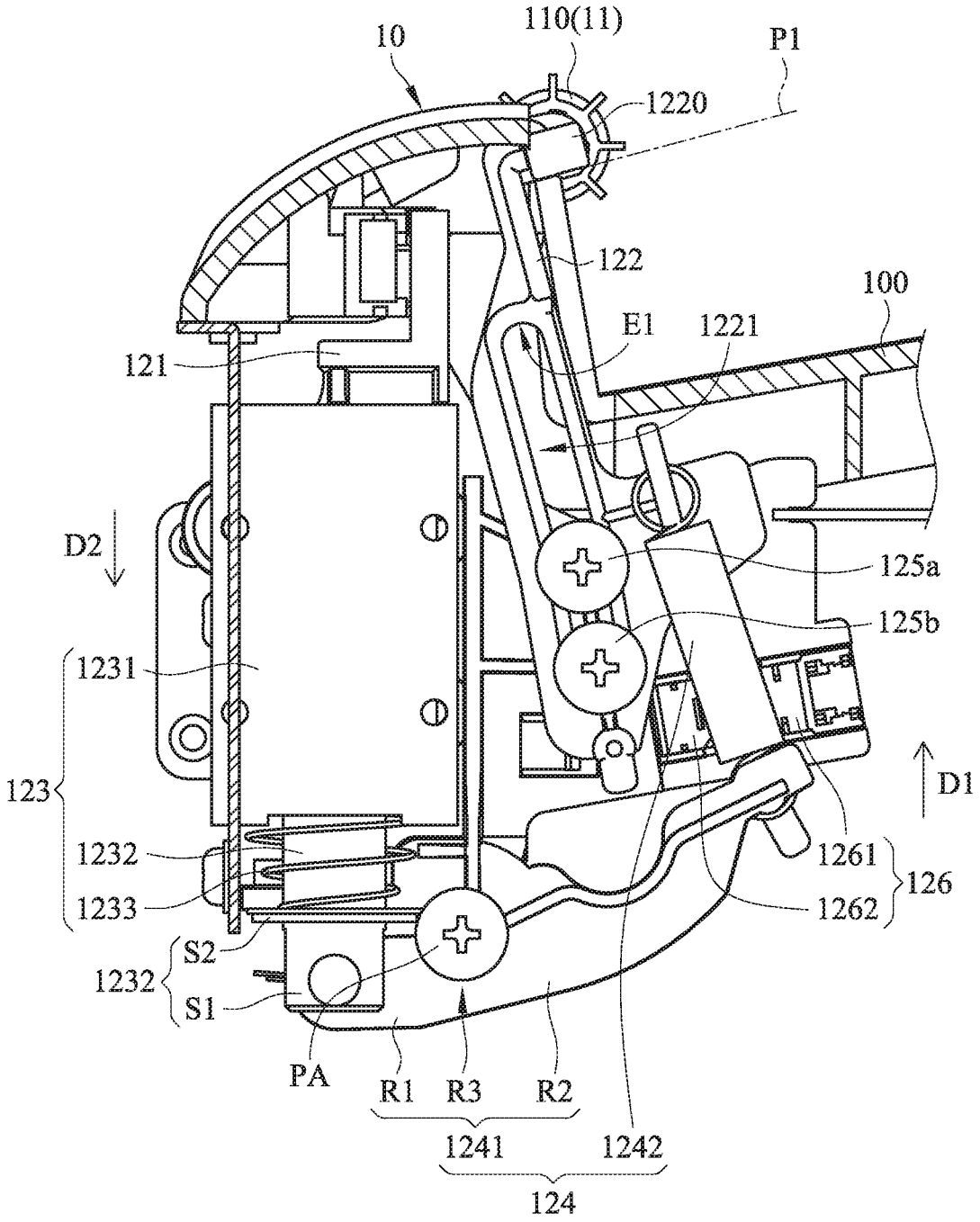
FIG. 3 is a schematic cross-sectional view illustrating the action of the paper pressing mechanism as shown in FIG. 2, in which the protrusion block of the pressing bar is in the initial position.
Figure 4:
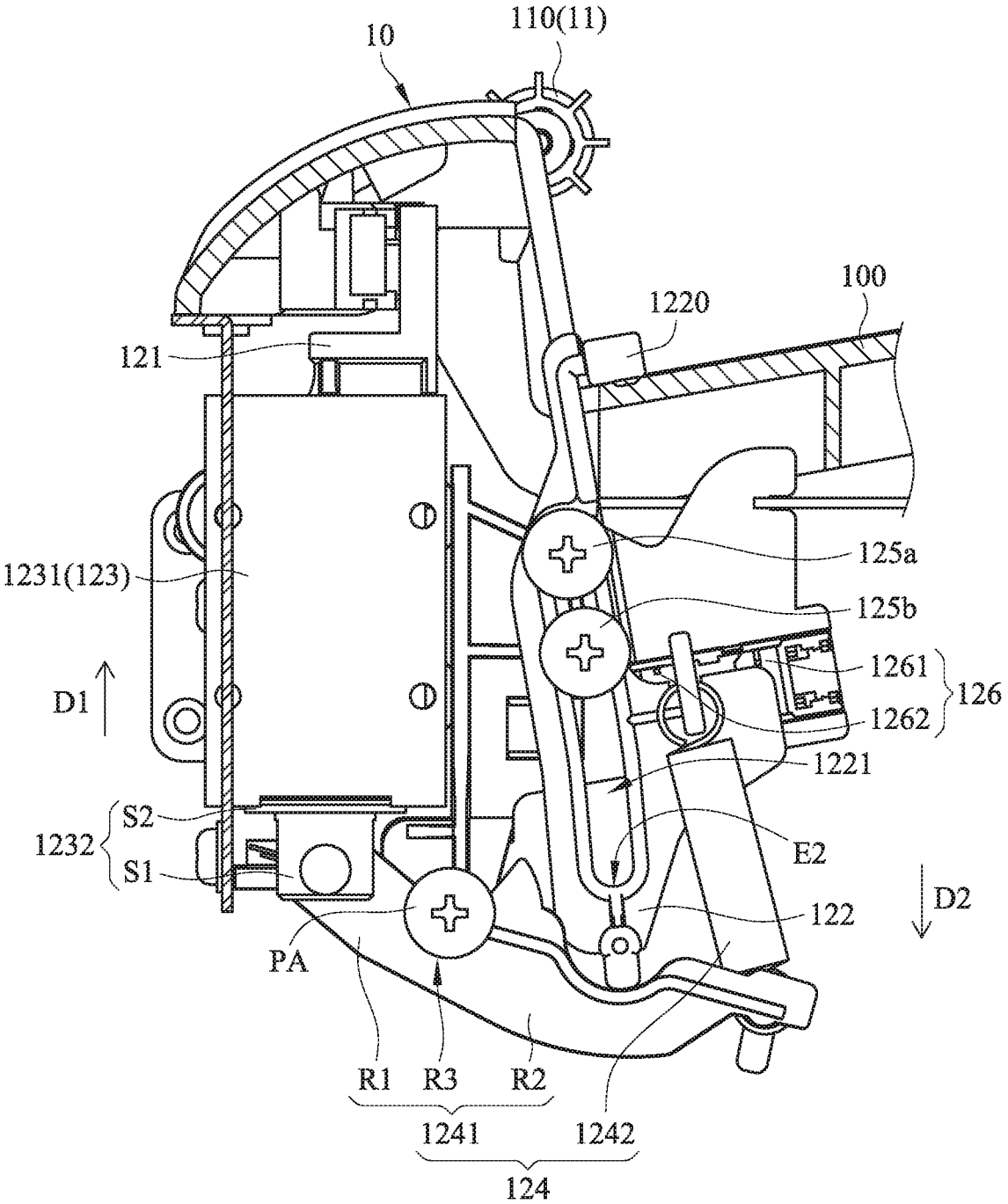
FIG. 4 is a schematic cross-sectional view illustrating the action of the paper pressing mechanism as shown in FIG. 2, in which the protrusion block of the pressing bar is in the target position.

Please refer to FIGS. 3 and 4. FIG. 3 is a schematic cross-sectional view illustrating the action of the paper pressing mechanism as shown in FIG. 2, in which the protrusion block of the pressing bar is in the initial position. FIG. 4 is a schematic cross-sectional view illustrating the action of the paper pressing mechanism as shown in FIG. 2, in which the protrusion block of the pressing bar is in the target position.

As shown in FIG. 3, the paper processing device 1 is not enabled, and the protrusion block 1220 of the pressing bar 122 is in the initial position P1. In FIG. 4, the solenoid valve body 1231 is electrically conducted. Consequently, the solenoid valve body 1231 drives the movement of the electromagnetic push rod 1232 in a first direction D1. That is, the electromagnetic push rod 1232 is moved in the direction toward the paper placement platform 100. At the same time, the spring 1233 is compressed in the first direction D1 by the electromagnetic push rod 1232, and the linking structure 1241 is swung relative to the positioning shaft PA of the support frame 121. That is, by using positioning shaft PA of the support frame 121 as a fulcrum, the linking structure 1241 is seesawed. Under this circumstance, the first linking part R1 of the linking structure 1241 is moved in the first direction D1, and the second linking part R2 of the linking structure 1241 is moved in a second direction D2. The second direction D2 is opposite to the first direction D1. That is, the second linking part R2 of the linking structure 1241 is moved in the direction away from the paper placement platform 100. As the second linking part R2 of the linking structure 1241 is moved in the second direction D2, the elastic linkage 1242 is stretched by the second linking part R2 of the linking structure 1241. Consequently, the elastic linkage 1242 generates an elastic restoring force. In response to the elastic restoring force of the elastic linkage 1242, the pressing bar 122 is moved in the second direction D2 and the protrusion block 1220 is moved toward the paper placement platform 100.

For clearly describing the linking relationships between the associated components of the paper pressing mechanism 12, the papers on the paper placement platform 100 are not shown in FIG. 4. In case that no papers are placed on the paper placement platform 100, the protrusion block 1220 of the pressing bar 12 will be in contact with the paper placement platform 100. In case that plural papers are placed on the paper placement platform 100, the protrusion block 1220 of the pressing bar 12 will be moved to the target position P2 (see FIG. 2) to contact with the papers.

Please refer to FIG. 3. The solenoid valve body 1231 is switched from the electrically-conducted state to a shut-off state. Consequently, the compressed spring 1233 is released. In response to the elastic restoring force of the spring 1233, the electromagnetic push rod 1232 is moved in the second direction D2. That is, the electromagnetic push rod 1232 is moved in the direction away from the paper placement platform 100. As the electromagnetic push rod 1232 is moved away from the paper placement platform 100, the linking structure 1241 is swung relative to the positioning shaft PA of the support frame 121. Under this circumstance, the first linking part R1 of the linking structure 1241 is moved in the second direction D2, and the second linking part R2 of the linking structure 1241 is moved in the first direction D1. As the second linking part R2 of the linking structure 1241 is moved in the first direction D1, the elastic linkage 1242 is moved with the second linking part R2 of the linking structure 1241 and moved in the first direction D1. As the elastic linkage 1242 is moved in the first direction D1, the pressing bar 122 is moved in the first direction D1 and the protrusion block 1220 is returned to the initial position P1.

In this embodiment, the transfer roller assembly 11 comprises plural rollers 110. These rollers 110 are spaced apart. When the protrusion block 1220 of the pressing bar 122 is in the initial position P1, the protrusion block 1220 is arranged between two adjacent rollers 110 of the plural rollers 110 (see FIG. 1). The protrusion block 1220 has a tetragonal cross section. The long side and the short side of the protrusion block 1220 are smaller than the diameter of each roller 110.

Consequently, when the protrusion block 1220 of the pressing bar 122 is in the initial position P1, the protrusion block 1220 is hidden in the space between the two adjacent rollers 110. Under this circumstance, the action of transferring the papers to the paper placement platform 100 by the transfer roller assembly 11 is not adversely affected.

In the above embodiment, the driving mechanism 123 comprises the solenoid valve body 1231, the electromagnetic push rod 1232 and the spring 1233. It is noted that the example of the driving mechanism 123 is not restricted. For example, in another embodiment, the driving mechanism 123 is a motor for driving the linking mechanism 124.

Figure 5:
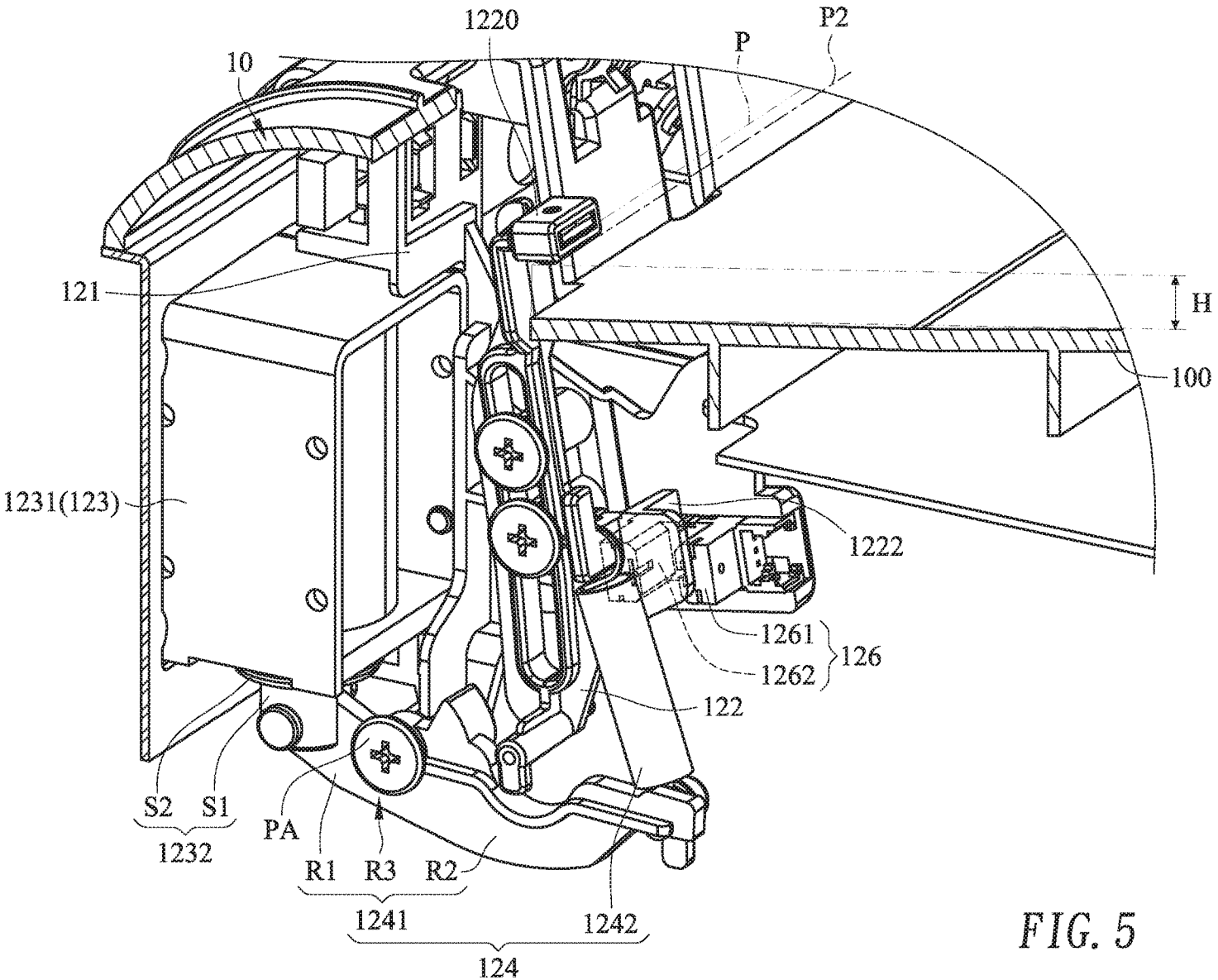
FIG. 5 is a schematic cutaway view illustrating a portion of the paper processing device according to the embodiment of the present invention, in which a stack height of the papers is sensed by the paper pressing mechanism.

FIG. 5 is a schematic cutaway view illustrating a portion of the paper processing device according to the embodiment of the present invention, in which a stack height of the papers is sensed by the paper pressing mechanism. Please refer to FIGS. 2 and 5. The pressing bar 122 further comprises a light-shielding structure 1222. The paper pressing mechanism 12 further comprises a sensor 126. The sensor 126 is installed on the support frame 121. Moreover, the sensor 126 is located beside the pressing bar 122. As the protrusion block 1220 is moved from the initial position P1 to the target position P2, the protrusion block 1220 is contacted with the plural papers P. If the stack height H of the papers P is lower than a threshold height, the light-shielding structure 1222 of the pressing bar 122 is located within a sensitive range of the sensor 126. Meanwhile, a conveying mechanism (not shown) on the paper placement platform 100 conveys the papers P to the stapling mechanism 13, which is located beside the paper placement platform 100. Consequently, the stapling mechanism 13 performs the stapling action on the papers P. If the stack height H of the papers P is higher than the threshold height when the protrusion block 1220 is moved from the initial position P1 to the target position P2 and contacted with the plural papers P, the light-shielding structure 1222 of the pressing bar 122 is not located within the sensitive range of the sensor 126. The relative position between the light-shielding structure 1222 and the sensitive range of the sensor 126 can be seen in FIG. 2. Meanwhile, the plural papers P are exited from the conveying mechanism (not shown) on the paper placement platform 100, and the stapling action is not performed on the papers P. In an embodiment, the sensor 126 is an infrared sensor. It is noted that the type of the sensor 126 is not restricted. That is, the type of the sensor 126 may be varied according to the practical requirements. In case that the sensor 126 is the infrared sensor, the infrared sensor comprises a signal emitter 1261 and a signal receiver 1262. The signal emitter 1261 and the signal receiver 1262 are opposed to each other. The sensitive range of the sensor 126 is defined by the signal emitter 1261 and the signal receiver 1262.

From the above descriptions, the present invention provides a paper processing device with a paper pressing mechanism. By the paper pressing mechanism, the papers on a paper placement platform is flattened and the stack height of the papers is sensed. The paper pressing mechanism comprises a pressing bar, a driving mechanism and a linking mechanism. By the driving mechanism and the linking mechanism, the pressing bar is moved upwardly or downwardly in the linear direction. Due to this design, the uplifted papers are not kicked out by the pressing bar during the linear movement. Consequently, the subsequent processes of flattening the papers and sensing the stack height of the papers can be performed more successfully. Moreover, the process of stacking the papers is not influenced by the linear movement of the pressing bar. Due to the linear movement of the pressing bar, the occupied space of the pressing bar in the paper processing device is largely reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A paper processing device for processing plural papers from a printing device, the paper processing device comprising:

a casing comprising a paper placement platform, wherein the paper placement platform is extended externally from the casing;

a transfer roller assembly installed on the casing, wherein the plural papers from the printing device are transferred to the paper placement platform by the transfer roller assembly; and a paper pressing mechanism located under the casing, and comprising:

a support frame;

a pressing bar installed on the support frame, and comprising a protrusion block, wherein the protrusion block is penetrated through an opening of the casing, and the protrusion block and the paper placement platform face each other;

a driving mechanism installed on the support frame; and a linking mechanism installed on the support frame, and connected between the driving mechanism and the pressing bar, wherein while the linking mechanism is driven by the driving mechanism, the pressing bar is moved with the linking mechanism and moved linearly relative to the support frame, and the protrusion block is moved from an initial position to a target position so as to be in contact with the plural papers.

2. The paper processing device according to claim 1, wherein the pressing bar further comprises a light-shielding structure, the paper pressing mechanism further comprises a sensor, and the sensor is installed on the support frame and located beside the pressing bar, wherein if a stack height of the plural papers is lower than a threshold height when the protrusion block is moved from the initial position to the target position and contacted with the plural papers, the light-shielding structure of the pressing bar is within a sensitive range of the sensor, wherein if the stack height of the plural papers is higher than the threshold height when the protrusion block is moved from the initial position to the target position and contacted with the plural papers, the light-shielding structure of the pressing bar is not within the sensitive range of the sensor.

3. The paper processing device according to claim 2, wherein the sensor is an infrared sensor, and the infrared sensor comprises a signal emitter and a signal receiver, wherein the signal emitter and the signal receiver are opposed to each other, and the sensitive range of the sensor is defined by the signal emitter and the signal receiver collaboratively.

4. The paper processing device according to claim 1, wherein the driving mechanism comprises:

a solenoid valve body;

an electromagnetic push rod installed in the solenoid valve body, and comprising a connecting part and a contacting part, wherein the connecting part and the contacting part are exposed outside the solenoid valve body, and the contacting part is arranged between the connecting part and the solenoid valve body; and a spring sheathed around the electromagnetic push rod, wherein two ends of the spring are contacted with the solenoid valve body and the contacting part, respectively.

5. The paper processing device according to claim 4, wherein the support frame comprises a positioning shaft, the linking mechanism comprises a linking structure and an elastic linkage, and the linking structure comprises a first linking part, a second linking part and a pivotal hole, wherein the first linking part is pivotally coupled to the connecting part of the electromagnetic push rod, the second linking part is connected with the elastic linkage, the pivotal hole is arranged between the first linking part and the second linking part, the positioning shaft of the support frame is pivotally coupled to the pivotal hole, and the elastic linkage is connected between the pressing bar and the second linking part.

6. The paper processing device according to claim 5, wherein when the solenoid valve body is in an electrically-conducted state, the solenoid valve body drives a movement of the electromagnetic push rod in a first direction to compress the spring, and the movement of the electromagnetic push rod allows the linking structure to be swung relative to the positioning shaft, so that the first linking part is moved in the first direction and the second linking part is moved in a second direction opposite to the first direction, wherein while the second linking part is moved in the second direction, the elastic linkage is stretched by the second linking part, so that the elastic linkage generates an elastic restoring force, wherein in response to the elastic restoring force of the elastic linkage, the pressing bar is moved in the second direction, and the protrusion block is moved to the target position and contacted with the plural papers.

7. The paper processing device according to claim 6, wherein when the solenoid valve body is switched from the electrically-conducted state to a shut-off state, the compressed spring is released, wherein in response to an elastic restoring force of the spring, the electromagnetic push rod is moved in the second direction and the movement of the electromagnetic push rod allows the linking structure to be swung relative to the positioning shaft, so that the first linking part is moved in the second direction and the second linking part is moved in the first direction, wherein while the second linking part is moved in the first direction, the elastic linkage is moved with the second linking part in the first direction, and the pressing bar is moved with the elastic linkage in the first direction, so that the protrusion block is returned from the target position to the initial position.

8. The paper processing device according to claim 1, wherein the transfer roller assembly comprises plural rollers, and the plural rollers are spaced apart, wherein when the protrusion block of the pressing bar is in the initial position, the protrusion block is arranged between two adjacent rollers of the plural rollers.

9. The paper processing device according to claim 1, wherein the paper pressing mechanism further comprises a fastening element, and the pressing bar further comprises a linear guiding slot, wherein the fastening element is penetrated through the linear guiding slot and fixed on the support frame, the linear guiding slot comprises a first stopping end and a second stopping end, and the first stopping end and the second stopping end are opposed to each other, wherein while the pressing bar is moved with the linking mechanism and moved linearly relative to the support frame and the protrusion block is moved to the target position, the first stopping end of the linear guiding slot is moved in a direction toward the fastening element, wherein when the protrusion block of the pressing bar is in the initial position, the second stopping end of the linear guiding slot is contacted with the fastening element.

10. The paper processing device according to claim 1, wherein the paper processing device further comprises a stapling mechanism, wherein the stapling mechanism is installed on the casing and located beside the paper placement platform, and the plural papers on the paper placement platform are stapled by the stapling mechanism.

* * * * *